US005427391A

United States Patent [19]

Cooper

[11] Patent Number: 5,427,391

[45] Date of Patent: Jun. 27, 1995

[54] PIVOTED KNEE SKATES

[76] Inventor: Bobby E. Cooper, Rte. 3, Box 480, Grundy, Va. 24614

[21] Appl. No.: 238,486

[22] Filed: May 5, 1994

[51] Int. Cl.[6] ..... A63C 17/01

[52] U.S. Cl. ..... 280/11.19; 280/809; 280/87.021

[58] Field of Search ..... 280/841, 11.19, 11.27, 280/11.28, 11.3, 809, 811, 18, 32.5, 32.6, 87.01, 87.021, 87.03, 87.042

[56] References Cited

U.S. PATENT DOCUMENTS

| | | | |
|---|---|---|---|
| 2,400,535 | 5/1946 | Celmer | 280/11.19 |
| 2,448,427 | 8/1948 | Gordon | 280/32.5 |
| 3,689,092 | 9/1972 | Lake | 280/809 X |
| 4,028,761 | 6/1977 | Taylor | 280/18 X |
| 4,413,832 | 11/1983 | Pendleton | 280/18 X |
| 4,930,796 | 6/1990 | Harrod | 280/87.021 |

*Primary Examiner*—Margaret A. Focarino

*Assistant Examiner*—Michael Mar

[57] ABSTRACT

A pivoted knee skate comprising a leg rest having an upper surface and lower surface; a foot rest having an upper surface and a lower surface; a plurality of wheels; a coupling mechanism rotatably coupling wheels to the lower surface of the leg rest and wheels to the lower surface of the foot rest; a securement mechanism coupled to the leg rest and foot rest for securing the upper surface of leg rest to the lower leg of a user and the upper surface of the foot rest to the foot of a user; and a hinge mechanism securing the leg rest to the foot rest, whereby creating a mobile platform for supporting a user's lower leg and foot, thus allowing a user to glide across a surface upon assuming a kneeling position thereon, and providing pivotal movement of the foot rest relative to the leg rest, thus allowing a user to stand or walk in an erect position with the platform coupled thereon.

4 Claims, 3 Drawing Sheets

FIG. 1
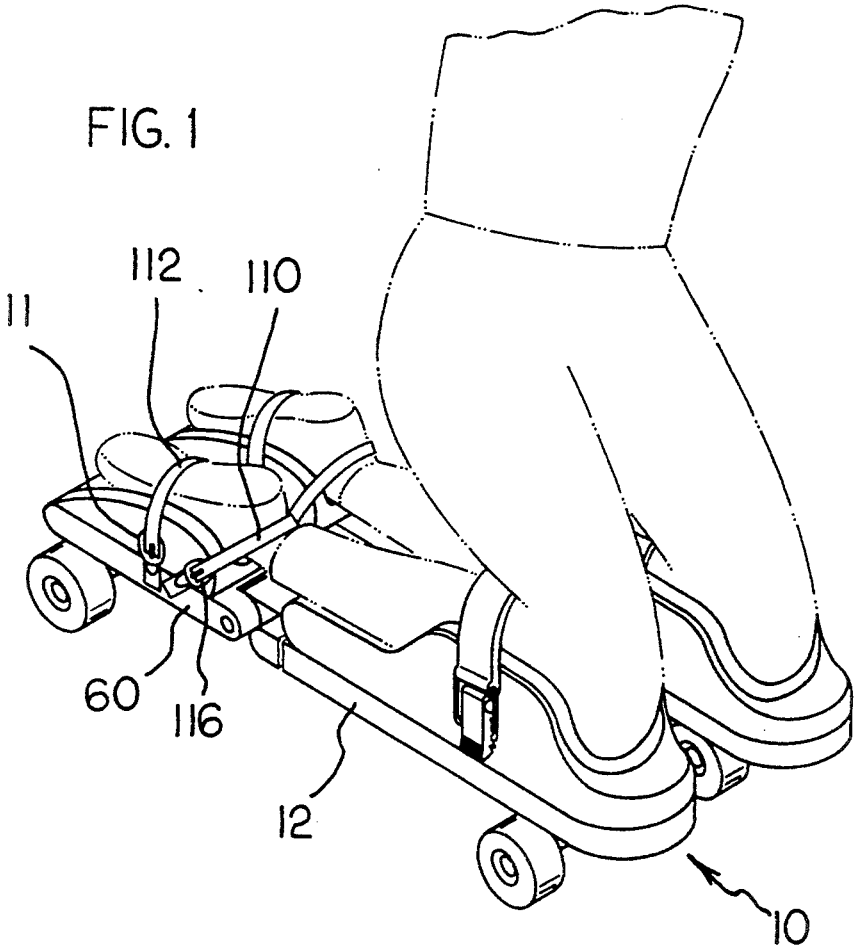
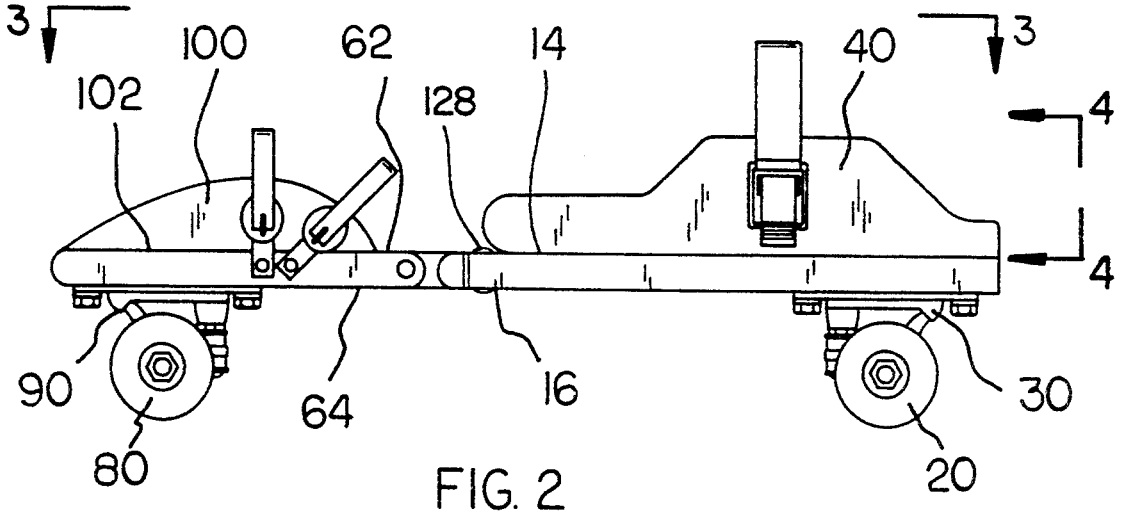
FIG. 2

FIG. 5
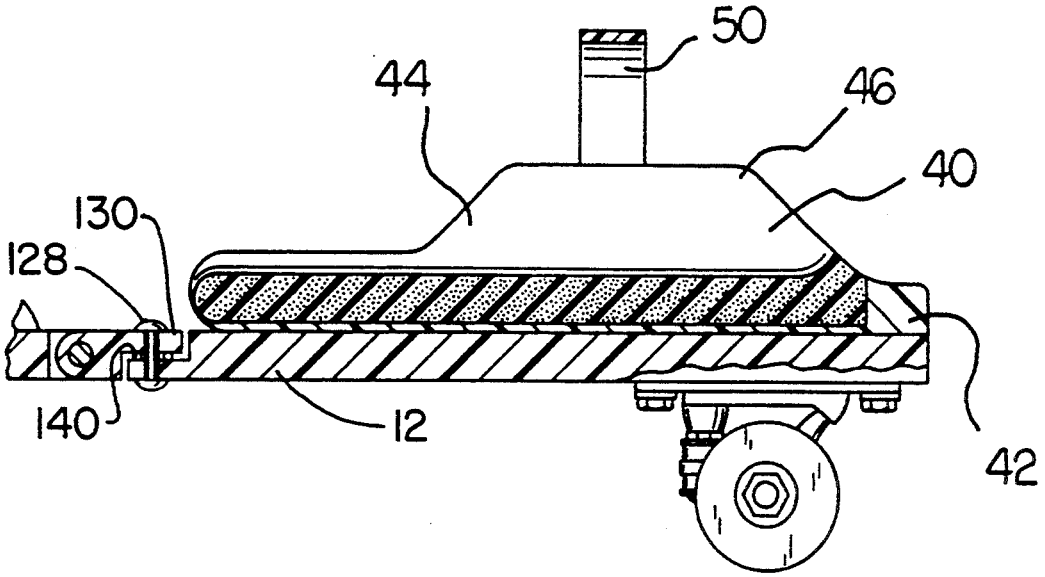
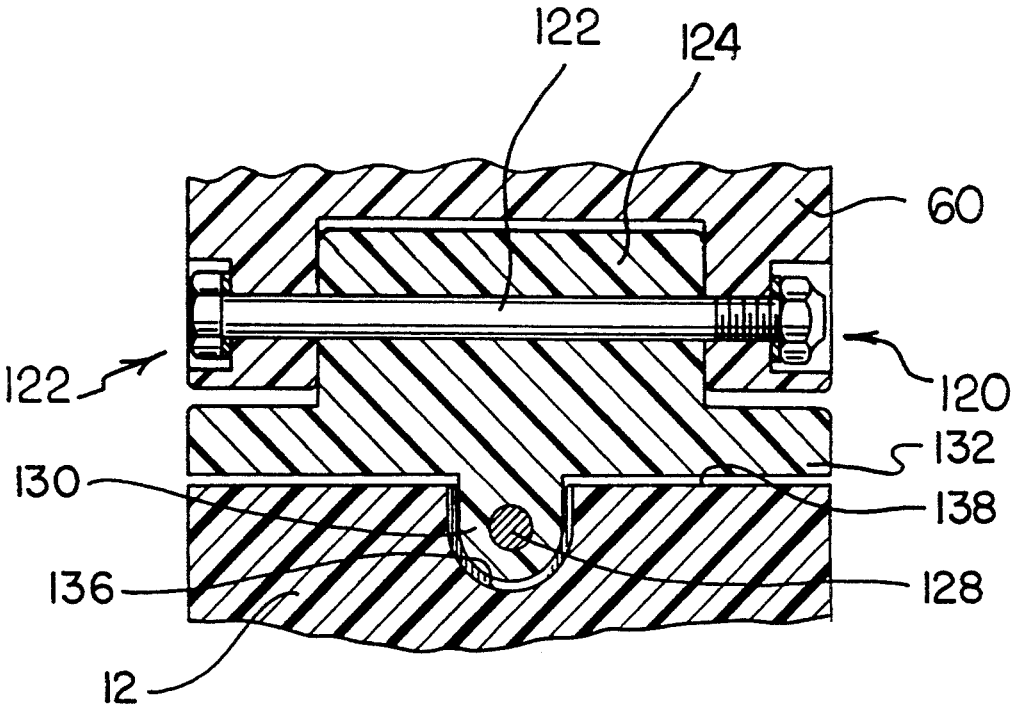
FIG. 6

PIVOTED KNEE SKATES

BACKGROUND OF THE INVENTION

1. Field of the Invention

The present invention relates to pivoted knee skates and more particularly pertains to gliding a user across a surface from one location to another with centrally pivoted knee skates.

2. Description of the Prior Art

The use of skates is known in the prior art. More specifically, skates heretofore devised and utilized for the purpose of gliding a user across a surface from one location to another are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,844,492 to Ludwig discloses a two wheeled roller skate. Other patents containing components generally related to the present invention are U.S. Pat. Nos. 4,116,236 to Albert which discloses a knee brace with a kneecap-encircling flexible resilient pad; U.S. Pat. No. 4,623,158 to Monreal which discloses a sporting knee boot for sliding, skating and skiing; U.S. Pat. No. 5,026,080 to Steffl which discloses castering wheels for roller skates; and U.S. Pat. No. 5,078,127 to Daneman which discloses a knee brace with an articulating brace hinge axis.

While these devices fulfill their respective, particular objective and requirements, the aforementioned patents do not describe a pivoted knee skate that allows a user to skate in a kneeled position or walk in an erect position with the skate coupled thereon.

In this respect, the pivoted knee skate according to the present invention substantially departs from the conventional concepts and designs of the prior art, and in doing so provides an apparatus primarily developed for the purpose of gliding a user across a surface from one location to another.

Therefore, it can be appreciated that there exists a continuing need for new and improved pivoted knee skate which can be used for gliding a user across a surface from one location to another. In this regard, the present invention substantially fulfills this need.

SUMMARY OF THE INVENTION

In the view of the foregoing disadvantages inherent in the known types of skates now present in the prior art, the present invention provides an improved pivoted knee skate. As such, the general purpose of the present invention, which will be described subsequently in greater detail, is to provide a new and improved pivoted knee skate and method which has all the advantages of the prior art and none of the disadvantages.

To attain this, the present invention essentially comprises, in combination, an essentially planar and rectangular leg rest having an upper surface and lower surface with a front edge, rear edge, and side edges integrally disposed therearound. A first pair of axially aligned wheels is included. Also included is first coupling means rotatably coupling the first pair of wheels to the lower surface of the leg rest near the front edge. An elongated shin pad is included and has a lower surface coupled to the upper surface of the leg rest, an upper surface formed to support a user's shin and knee thereon, and an upwardly extending front edge and adjacent side edges adapted to hold a user's shin and knee in a generally stationary position with respect thereto. An elongated leg strap is included and further comprises a first segment and a second segment, the first segment having one end coupled to one side edge of the shin pad and the other end having a securable means coupled thereto, the second segment having one end coupled to the opposite side edge of the shin pad and the other end having a securement means coupled thereto and aligned with the securable means of the first segment, the securement means adapted to receive and hold the securable means with the strap in a closed loop configuration around the lower leg of a user. An essentially planar foot rest is included and has an upper surface and a lower surface with a front edge, rear edge, and side edges integrally disposed therearound. A second pair of axially aligned wheels is included. A second coupling means is included and rotatably couples the second pair of wheels to the lower surface of the foot rest near the rear edge. An elongated foot pad is included and has a lower surface coupled to the upper surface of the foot rest, an upper surface for supporting a user's foot thereon, and upwardly extending side edges adapted to hold a user's foot in a generally stationary position with respect thereto. A first foot strap and a second foot strap are included. Each strap further comprises a first segment and a second segment. The first segment has one end coupled to a side edge of the foot rest with the other end having securable means coupled thereto. The second segment has one end coupled to the opposite side edge of the foot rest and is aligned with the first segment with the other end having a securement means coupled thereto. The securement means is adapted to receive and hold the securable means with the first strap in a closed loop configuration around the ankle of a user and the second strap in a closed loop configuration around the foot of a user near the arch thereof. Hinge means secure the rear edge of the leg rest to the front edge of the foot rest, whereby creating a mobile platform for supporting a user's lower leg and foot, thus allowing a user to glide across a surface upon assuming a kneeling position thereon. The hinge means also provide pivotal movement of the foot rest relative to the leg rest, thus allowing a user to stand or walk in an erect position with the platform coupled thereon.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pivoted knee skate which has all the advantages of the prior art skate and none of the disadvantages.

It is another object of the present invention to provide a new and improved pivoted knee skate which may be easily and efficiently manufactured and marketed.

It is a further object of the present invention to provide a new and improved pivoted knee skate which is of durable and reliable construction.

An even further object of the present invention is to provide a new and improved pivoted knee skate which is susceptible of a low cost of manufacture with regard to both materials and labor, and which accordingly is then susceptible of low prices of sale to the consuming public, thereby making such a pivoted knee skate economically available to the buying public.

Still yet another object of the present invention is to provide a new and improved pivoted knee skate which provides in the apparatuses and methods of the prior art some of the advantages thereof, while simultaneously overcoming some of the disadvantages normally associated therewith.

Even still another object of the present invention is to provide a new and improved pivoted knee skate for gliding a user across a surface from one location to another.

Lastly, it is an object of the present invention is to provide a new and improved pivoted knee skate comprising a leg rest having an upper surface and lower surface; a foot rest having an upper surface and a lower surface; a plurality of wheels; coupling means rotatably coupling wheels to the lower surface of the leg rest and wheels to the lower surface of the foot rest; securement means coupled to the leg rest and foot rest for securing the upper surface of leg rest to the lower leg of a user and the upper surface of the foot rest to the foot of a user; and hinge means securing the leg rest to the foot rest, whereby creating a mobile platform for supporting a user's lower leg and foot, thus allowing a user to glide across a surface upon assuming a kneeling position thereon, and providing pivotal movement of the foot rest relative to the leg rest, thus allowing a user to stand or walk in an erect position with the platform coupled thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of a pair of pivoted knee skates constructed in accordance with the principles of the present invention in an operational configuration attached to a user's legs.

FIG. 2 is a side view of a pivoted knee skate as depicted in FIG. 1.

FIG. 5 is a cross sectional view of the leg rest and shin pad of the present invention.

FIG. 6 is a cross sectional view of the coupling mechanism used to couple the leg rest to the foot rest of the present invention.

The same reference numerals refer to the same parts through the various Figures.

DESCRIPTION OF THE PREFERRED EMBODIMENT

Figure 3:
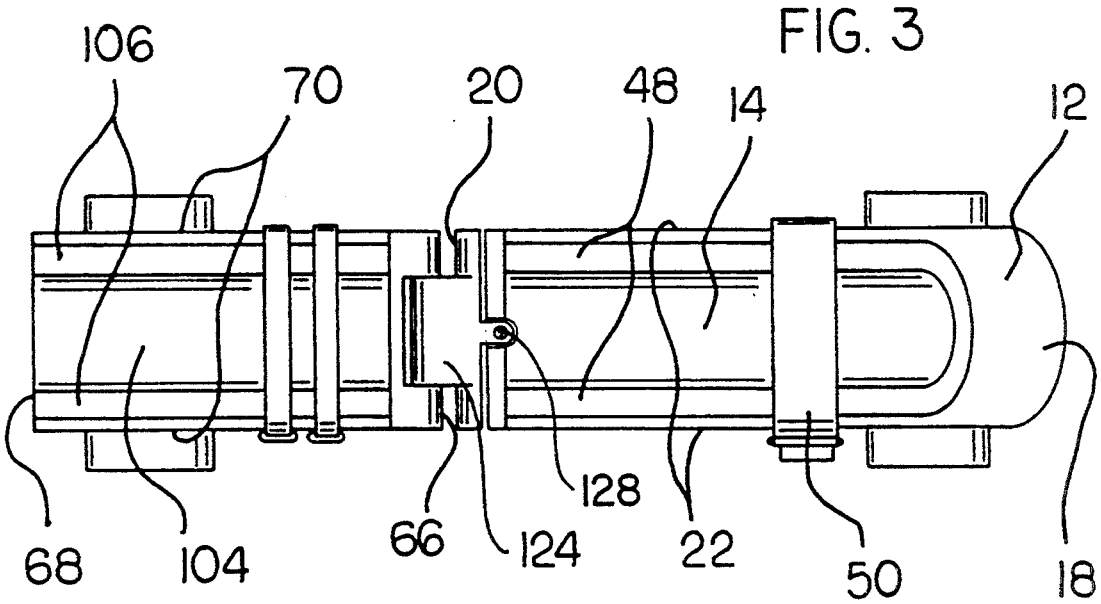
FIG. 3 is a plan view of the pivoted knee skate taken along the line 3—3 of FIG. 2.
Figure 4:
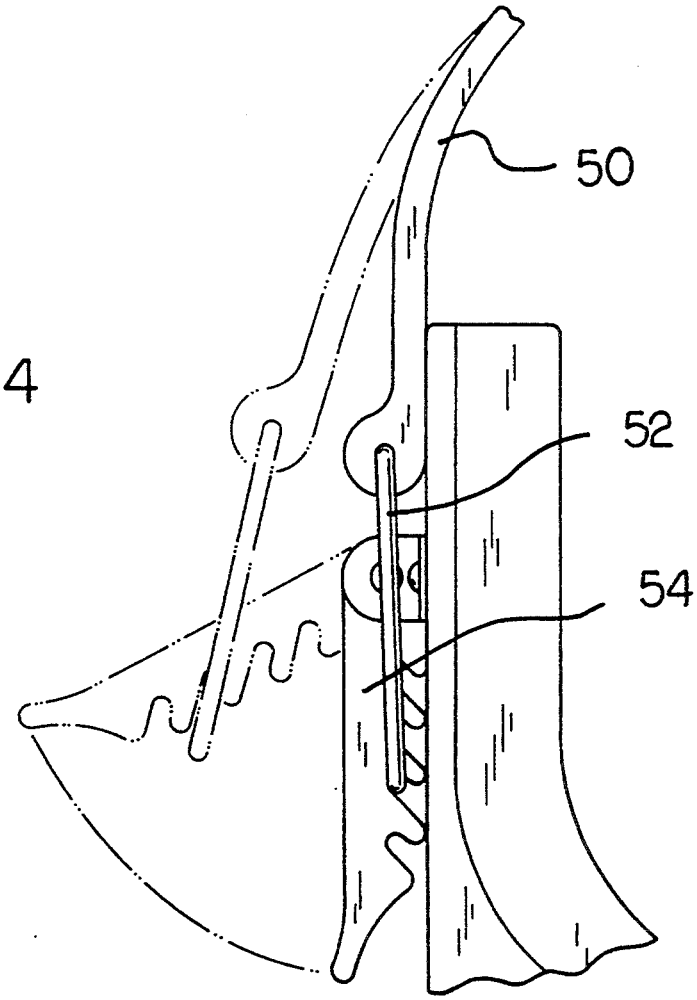
FIG. 4 is a view of the mechanism used to secure the present invention around the leg of a user taken along the line 4—4 of FIG. 2.

With reference now to the drawings, and in particular, to FIG. 1 thereof, the preferred embodiment of the new and improved pivoted knee skate embodying the principles and concepts of the present invention and generally designated by the reference number 10 will be described.

Specifically, the present invention includes eleven major components. The major components are the leg rest, the first pair of wheels, the first coupling means, the shin pad, the leg strap, the foot rest, the second pair of wheels, the second coupling means, the foot pad, the foot straps, and the hinge means. These components are interrelated to provide the intended function.

More specifically, it will be noted in the various Figures that the first major component is the leg rest 12. The leg rest is essentially planar and rectangular in structure. The leg rest includes an upper surface 14 and a lower surface 16. The leg rest also has a front edge 18, a rear edge 20, and side edges 22 integrally disposed therearound.

The second major component is the first pair of wheels 20. Each wheel in the pair is offset from the other. The wheels are axially aligned for rotation thereof.

The third major component is the first coupling means 30. The coupling means has one portion thereof coupled to the first pair of wheels 20 to allow axial rotation thereof. The coupling means is then coupled to the lower surface 16 of the leg rest near the front edge 18.

The fourth major component is the shin pad 40. The shin pad has a lower surface 42 coupled to the upper surface 14 of the leg rest. The shin pad has an upper surface 44 formed to support a user's shin and knee thereon. The shin pad also includes an upwardly extending front edge 46 and adjacent side edges 48. The edges are adapted to hold a user's shin and knee in a generally stationary position on the pad.

The fifth major component is the elongated leg strap 50. The leg strap includes a first segment and a second segment. The first segment has one end coupled to one side edge of the shin pad 40 and the other end having a securable means 52 coupled thereto. The second segment has one end coupled to the opposite edge of the shin pad and the other end having a securement means 54 coupled thereto. The securement means is aligned with the securable means of the first segment. The securement means is adapted to receive and hold the securable means with the strap in a closed loop configuration around the lower leg of a user.

The sixth major component is a foot rest. The foot rest is essentially planar in structure. The foot rest includes an upper surface 62 and a lower surface 64. The foot rest has a front edge 66, a rear edge 68, and side edges 70 integrally disposed therearound.

The seventh major component is the second pair 80 of wheels. Each wheel in the pair is offset from the other. The wheels are aligned for rotation about a common axis.

The eighth major component is the second coupling means 90. The second coupling means has one portion rotatably coupled to the second pair of wheels 80. The coupling means has another portion coupled to the lower surface 64 of the foot rest near the rear edge 68.

The ninth major component is an elongated foot pad 100. The foot pad has a lower surface 102 coupled to the upper surface 62 of the foot rest. The foot pad has an upper surface 104 for supporting a user's foot thereon. The foot pad also had upwardly extending side edges 106 adapted to hold a user's foot in a generally stationary position thereon.

The tenth major component is the foot straps. The present invention includes a first foot strap 110 and a second foot strap 112. Each strap further includes a first segment and a second segment. The first segment has one end coupled to a side edge of the foot rest and the other end having a securable means 114 coupled thereto. The second segment has one end coupled to the opposite side edge of the foot rest and is aligned with the first segment. The other end of the second segment has a securement means 116 coupled thereto. The securement means is adapted to receive and hold the securable means with the first strap in a closed loop configuration around the ankle of a user and the second strap in a closed loop configuration around the foot of a user near the arch thereof.

The eleventh major component is the hinge means 120. The hinge means are used to secure the rear edge 20 of the leg rest to the front edge 66 of the foot rest. The hinge means includes a pin 122 coupled between the leg rest and the foot rest. The hinge means also includes a tongue 124 having one end coupled to the upper surface 14 of the leg rest near the rear edge 20 and another end extended above the upper surface 62 of the foot rest near the front edge 66. The tongue is used to create a mobile platform 122 for supporting a user's lower leg and foot when the foot rest and leg rest are planarly aligned. This platform allows a user to glide across a surface upon assuming a kneeling position thereon. The pin allows the foot rest to pivot with respect the leg rest, thus enabling a user to stand or walk in an erect position with the platform coupled thereon.

Adjacent to the rearward end of the leg rest 12, a joint is provided in movement about a vertical axis of rotation. The axis of rotation is through the center of a vertically disposed pin 128. Such pin is positioned through a semicircular projection 130 extending forwardly from an extension 132 of the leg rest 12. Such projection is located in a semicircular recess 136 in the upper half of the rearward edge 138 of the leg rest 12. The horizontal surface beneath the recess 136 and the lower surface of the projection 130 constitute bearing surfaces 140 to allow rotation of the device adjacent to a mid point about a vertical axis for movement between the front and rear wheels from left to right and right to left.

In the preferred embodiment, the leg rest and foot rest can be made of wood, fiberglass, molded plastic, or any other similar rigid material. Conventional skate wheels and associated axial coupling mechanisms are utilized. The pads can be made of rubber or fabric, or similar material. The straps are conventional in design and coupled by buckles or pile type fasteners.

The pivoted knee skates are used in the work place where users have to perform work in a kneeling position. The knee skates also allow users who can not ride a skate board or roller skates to participate in skating activities. The skates are used in several modes of operation. They allow users to propel themselves by their feet from one location to another, glide themselves on their knees from one location to another, and propel themselves by their feet and then subsequently drop to their knees to glide from one location to another.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A pivoted knee skate for gliding a user across a surface from one location to another comprising, in combination:

an essentially planar and rectangular leg rest having an upper surface and lower surface with a front edge, rear edge, and side edges integrally disposed therearound;

a first pair of axially aligned wheels;

first coupling means rotatably coupling the first pair of wheels to the lower surface of the leg rest near the front edge;

an elongated shin pad having a lower surface coupled to the upper surface of the leg rest, an upper surface formed to support a user's shin and knee thereon, and an upwardly extending front edge and adjacent side edges adapted to hold a user's shin and knee in a generally stationary position with respect thereto;

an elongated leg strap further comprising a first segment and a second segment, the first segment having one end coupled to one side edge of the shin pad and the other end having a securable means coupled thereto, the second segment having one end coupled to the opposite side edge of the shin pad and the other end having a securement means coupled thereto and aligned with the securable means of the first segment, the securement means adapted to receive and hold the securable means with the strap in a closed loop configuration around the lower leg of a user;

an essentially planar foot rest having an upper surface and a lower surface with a front edge, rear edge, and side edges integrally disposed therearound;

a second pair of axially aligned wheels;

second coupling means rotatably coupling the second pair of wheels to the lower surface of the foot rest near the rear edge;

an elongated foot pad having a lower surface coupled to the upper surface of the foot rest, an upper surface for supporting an upper portion of a user's foot thereon, and upwardly extending side edges adapted to hold a user's foot in a generally stationary position with respect thereto;

a first foot strap and a second foot strap, each strap further comprising a first segment and a second segment, the first segment having one end coupled to a side edge of the foot rest and the other end having securable means coupled thereto, a second segment having one end coupled to the opposite side edge of the foot rest and aligned with the first segment and the other end having a securement means coupled thereto, the securement means adapted to receive and hold the securable means with the first strap in a closed loop configuration around the ankle of a user and the second strap in a closed loop configuration around the foot of a user near the arch thereof; and hinge means securing the rear edge of the leg rest to the front edge of the foot rest, whereby creating a mobile platform for supporting a user's lower leg and foot, thus allowing a user to glide across a surface upon assuming a kneeling position thereon, and providing pivotal movement of the foot rest relative to the leg rest, thus allowing a user to stand or walk in an erect position with the platform coupled thereon.

2. A pivoted knee skate comprising:

a leg rest having an upper surface and lower surface;

a foot rest having an upper surface and a lower surface;

a plurality of forward and rearward wheels;

coupling means rotatably coupling the forward wheels to the lower surface of the leg rest and the rearward wheels to the lower surface of the foot rest;

securement means coupled to the leg rest and foot rest for securing the upper surface of the leg rest to a forward portion of the lower leg of a user and the upper surface of the foot rest to an upper portion of the foot of a user; and hinge means securing the leg rest to the foot rest, whereby creating a mobile platform for supporting a user's lower leg and foot, thus allowing a user to glide across a surface upon assuming a kneeling position thereon, and providing pivotal movement of the foot rest relative to the leg rest, thus allowing a user to stand or walk in an erect position with the platform coupled thereon.

3. The device as set forth in claim 2 and further including a vertically oriented pivot pin to allow relative pivotal movement between the leg rest and the foot rest with the forward and rearward wheels coupled thereto.

4. The device as set forth in claim 2 further including cushioning means coupled to the platform for cushioning a user's foot and leg placed thereon.

* * * * *